United States Patent [19]

Keijer, Jan T.

[11] 4,028,016

[45] June 7, 1977

[54] ROTARY DISPLACEMENT COMPRESSOR WITH CAPACITY CONTROL

[75] Inventor: Jan T. Keijer, Rosmalen, Netherlands

[73] Assignee: Grasso's Koninklijke Machinefabrieken N.V., s-Hertogenbosch, Netherlands

[22] Filed: Dec. 31, 1975

[21] Appl. No.: 645,815

[30] Foreign Application Priority Data

Jan. 31, 1975 Netherlands ..... 7501187

[52] U.S. Cl. ..... 417/440; 418/159; 418/195

[51] Int. Cl.[2] ..... F04B 49/02; F01C 21/12; F01C 1/08; F04C 29/08

[58] Field of Search ..... 417/440, 310; 418/159, 418/195; 415/53

[56] References Cited

UNITED STATES PATENTS

| | | | |
|---|---|---|---|
| 2,938,663 | 5/1960 | Liick | 418/159 |
| 3,029,738 | 4/1962 | Clar | 418/159 |
| 3,088,659 | 5/1963 | Nilsson et al. | 418/159 |
| 3,133,695 | 5/1964 | Zimmern | 418/87 |
| 3,334,546 | 8/1967 | Vuolle-Apiala | 418/159 |
| 3,797,975 | 3/1974 | Keller | 418/159 |
| 3,804,564 | 4/1974 | Zimmern | 418/195 |
| 3,841,806 | 10/1974 | Zimmern | 418/195 |

FOREIGN PATENTS OR APPLICATIONS

| | | | |
|---|---|---|---|
| 868,385 | 9/1941 | France | 417/440 |

*Primary Examiner*—John J. Vrablik
*Attorney, Agent, or Firm*—Finnegan, Henderson, Farabow & Garrett

[57] ABSTRACT

A rotary displacement compressor having a driven cylindrical rotor inside a casing provided with spirally-extending grooves, and at least one gear in sealing engagement with the teeth of the rotor in which the axis of rotation of the gear intersects the axis of rotation of the rotor and in which the gas to be compressed is drawn-in through the open ends of the grooves at one end of the rotor and an exhaust port is located in the wall of the casing near the other end including a second port in the wall casing at the same axial height as each exhaust port, the port being in communication with the intake side of the compressor via a return pipe, and a regulating ring to control the size of the return port and the exhaust port.

5 Claims, 5 Drawing Figures

ROTARY DISPLACEMENT COMPRESSOR WITH CAPACITY CONTROL

The present invention relates to a rotary displacement compressor, comprising a driven cylindrical rotor provided with spirally-ex-tending grooves with which the teeth of at least one gear are in sealing engagement, the axis of rotation intersecting the axis of rotation of the rotor, in which the rotor is disposed inside a close-fitting cylindrical casing and part of the gear or gears traverse(s) the wall of said casing and in which the gas to be compressed is drawn-in through the open ends of the grooves at one head end of the rotor, and an exhaust port is present in the wall of the casing near the other head end of the rotor, seen in the direction of rotation of the rotor in front of the gear or every gear, and a pressure pipe is connected to said exhaust port.

A compressor of this kind, embodied as air compressor, is described in U.S. Pat. No. 3,133,695.

It is the object of the present invention to provide a compressor of this kind with a capacity control without, in principle, loss of capacity, which is particularly useful when being applied in refrigerating or freezing plants. Without capacity control and with a constant r.p.m. of the rotor, the compressor would draw off roughly the same gas volume independent of the need of cold required by the plant. In order to prevent a decrease of the suction pressure when the load of the evaporator of the plant is reduced, the compressor should be controlled so that a smaller volume is drawn-off.

However, also for compressors for air and other media a capacity control without, principally, loss of capacity is highly important.

The ratio between intake volume and pressure volume and, consequently, also the pressure ratio for a certain gas is always defined for any kind of compressor as a result of the structure.

The ratio between the intake volume and the pressure volume and, thus, also the pressure ratio of the compressor will preferably be chosen to such an extend that the pressure ratio corresponds with the ratio of gas pressure in front of and behind the compressor, said latter pressures being determined by the process in which the compressor is involved.

The object of the present invention is to adapt the compressor capacity to the need required, in which the ratio between intake volume and pressure volume, which applies to the maximum capacity, remains approximately constant during the reduction of the capacity, so that a regulation free of losses is obtained.

Another object of the invention is to vary the ratio between intake volume and pressure volume with maximum compressor capacity within certain limits so as to adapt the compressor to various process with different pressure ratios.

In accordance with the invention, both objects may be achieved independently of and in combination with each other.

In accordance with the invention, said objects are achieved in that a second port is present in the casing wall at the same axial height as each exhaust port, said second port being in communication with the intake side of the compressor via a return pipe, and in that a regulating ring is present being rotatable with respect to the casing, said ring may control the size of the return port from a completely closed position to a maximum open position and in doing so, said ring will adjust simultaneously the size of the exhaust port in the reverse sense.

When the regulating ring is rotated relatively to the casing so that the return port is opened, the moment at which the compression starts will be retarded and, consequently, the volume drawn-in is reduced. At the same time, the exhaust port is reduced so that the built-in volume ratio remains substantially constant with different capacities of the compressor.

The regulating ring preferably consists of a fully circular portion on which a mechanism may act to rotate the regulating ring relatively to the casing and side flaps are present in the same number as gears, in which one regulating edge of each side flap adjusts the exhaust port and the other regulating edge adjusts the return port.

By using such a regulating or filling ring it is also possible to change the volume ratio to a certain extent at full load of the compressor, i.e. by providing the side flaps of the regulating ring with other dimensions and/or forms.

The invention will now be explained more in detail with reference to the accompanying diagrammatic drawings, wherein.

Figure 1:
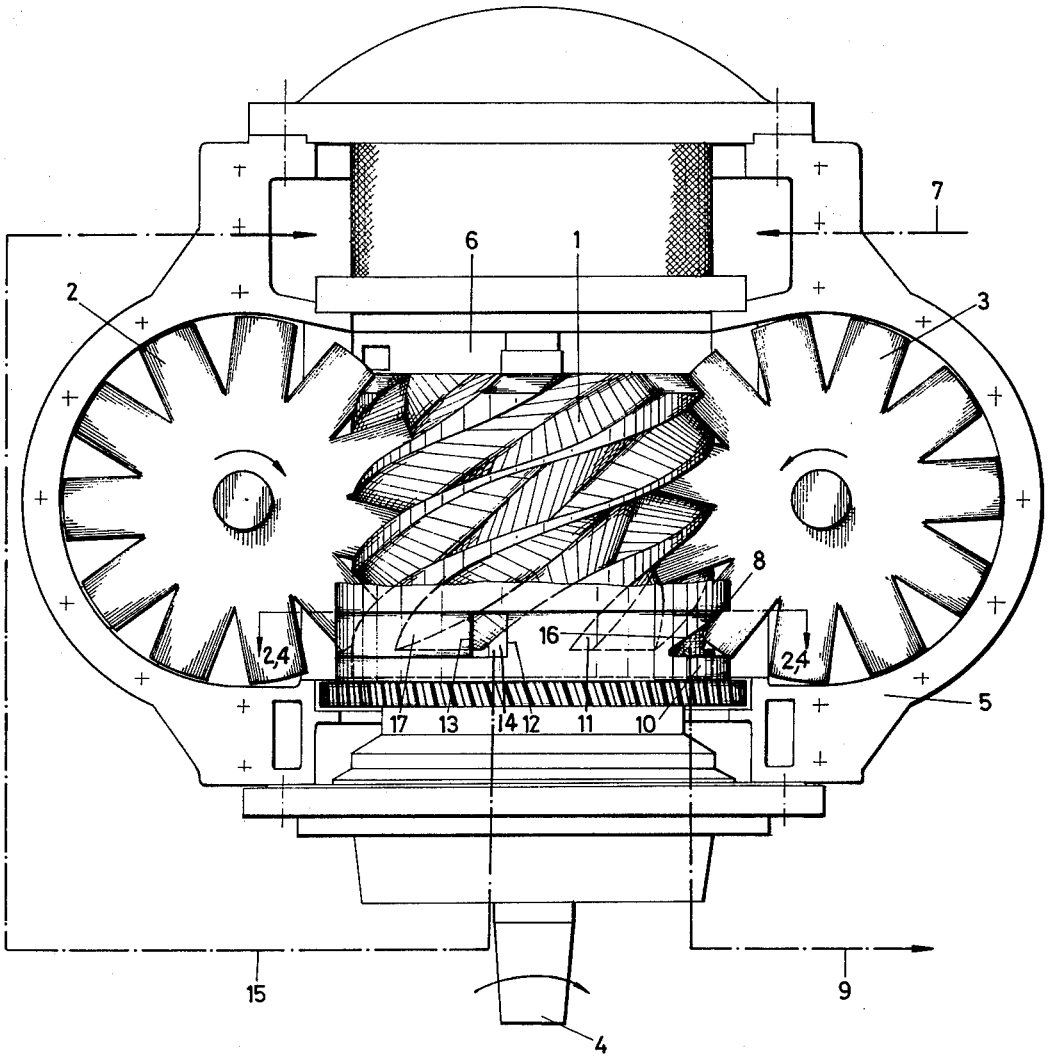
FIG. 1 is a top view of the compressor in accordance with the invention, comprising two gears and a capacity control.

FIG. 1 shows rotor 1 and the two gears are indicated by reference numeral 2 and 3. The rotor is driven via a shaft 4.

Figure 2:
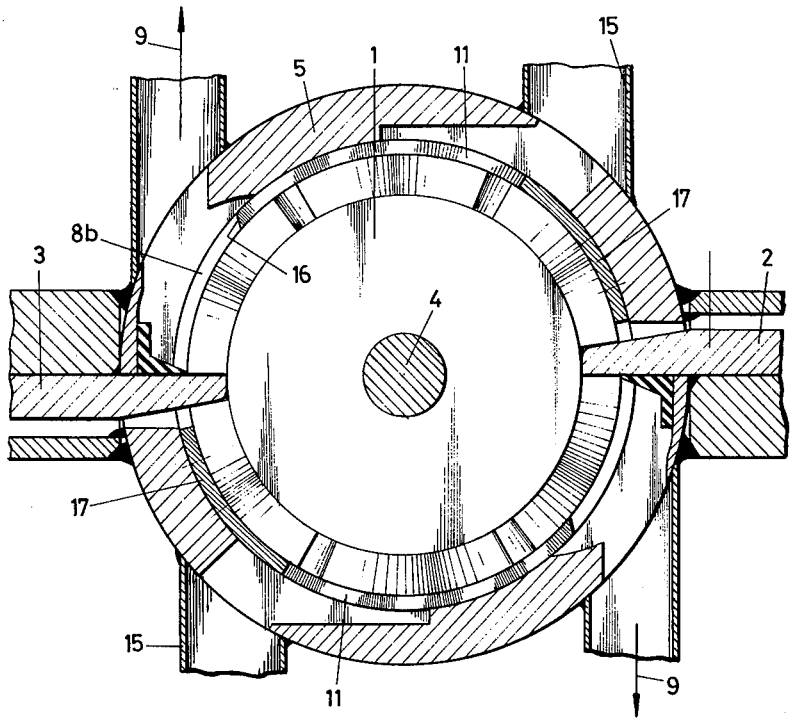
FIG. 2 is a section taken on line A—A of FIG. 1 at full load.
Figure 4:
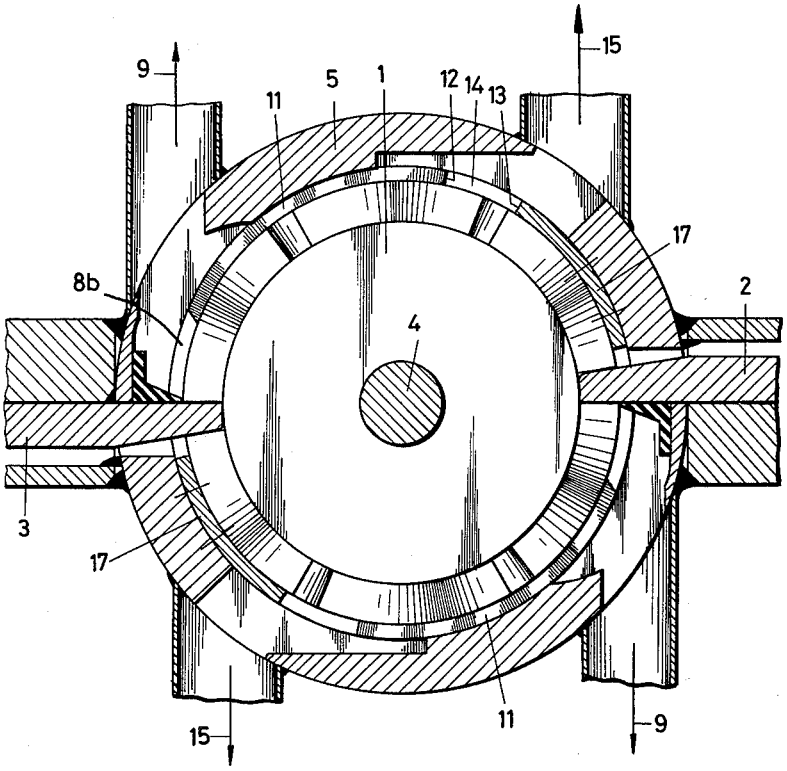
FIG. 4 is a section taken on line A—A of FIG. 1 at part load.

The rotor is surrounded by a cylindrical casing 5 and gears 2 and 3 extend through openings in the wall of the casing 5 (see FIG. 2 and 4).

In the case of a refrigerator compressor, the casing 5 is closed at both head ends. A suction chamber 6 is formed between a head end of the rotor 1 and one front surface of the casing 5. An intake pipe 7 connects to said suction chamber 6.

When the rotor 1 is rotating, the gas to be drawn-in will, therefore, be introduced into the grooves in the rotor via the open ends. At a certain moment, each open end is closed by a tooth of the gear 2 or 3 and compression starts, because each groove at the other end is closed by the wall of the casing 5.

At a certain moment the other end of each groove encounters an exhaust port 8 in the wall of the casing 5. A pressure pipe 9 is connected to said exhaust port.

The description so far relates to a known rotary displacement compressor without capacity control.

However, one wishes to have the possibility to control the capacity of the compressor in such a way that the ratio between intake volume and pressure volume, i.e. the volume ration, remains approximately constant over a range of regulation which is as large as possible.

In accordance with the invention, said object is achieved in that a closed regulating ring is used. Said ring fits a groove in the casing 5 or, if required, a recess in the rotor 1.

Means not illustrated may act on regulating ring 10 in order to be able to rotate said ring at a certain angle with respect to the casing 5.

For each half of the rotor, the regulating ring 10 is provided with a side flap 11 which constitutes the actual control element. At one end, the side flap 11 has a straight regulating edge 12, said edge together with a fixed regulating edge 13 in the casing defining an opening 14 (FIG. 4) in the wall of the casing 5.

Said opening 14, the so-called return port, is connected to a return pipe 15 being in communication with suction chamber 6.

In the position as illustrated in FIG. 1 said return port 14 is open. When the regulating ring 10 is rotated to such an extent that the regulating edges 12 and 13 butt against each other, the return opening 14 will be closed. This is the position at full load (see FIG. 2 and 3).

Figure 3:
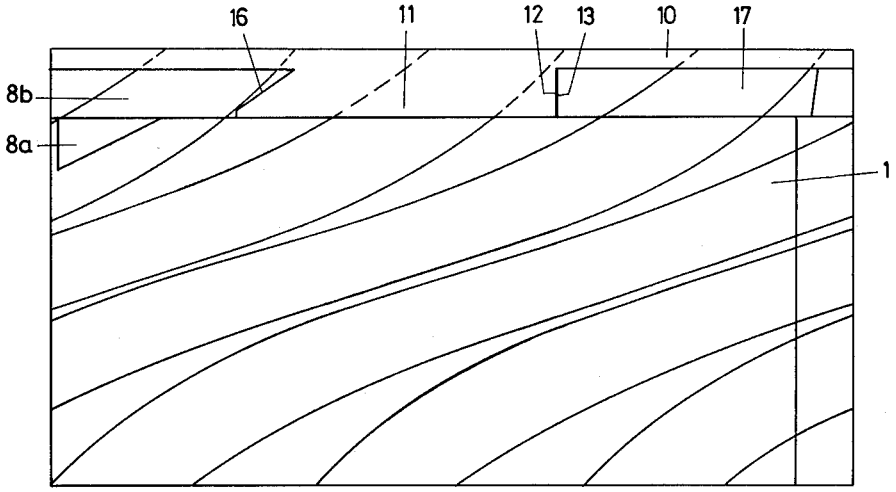
FIG. 3 illustrates a development of half of the rotor of the compressor in accordance with FIG. 1 at full load.
Figure 5:
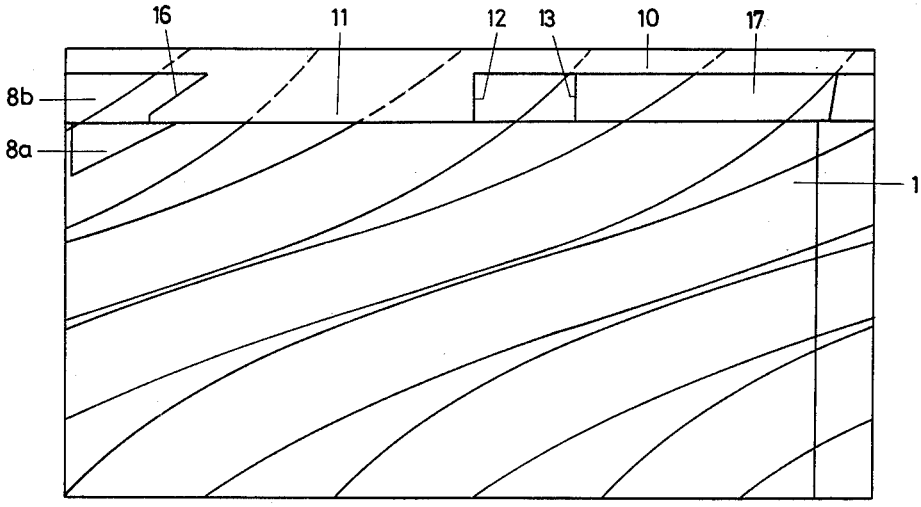
FIG. 5 is a development of half of the rotor at part load.

It appears also from FIG. 1, 3 and 5 that the aforementioned exhaust port 8 in fact consists of two elements, i.e. a fixed exhaust port 8*a* and an adjustable exhaust port 8*b* which may be enlarged or reduced by the inclined regulating edge 16 of the side flap 11. When the regulating ring is in a position of minimum part load, the adjustable exhaust port 8*b* is reduced, whereas the fixed exhaust port 8*a* keeps its size. The meaning of this is to obtain a limited starting moment for the driving motor during the process of starting. Little or no pressure is being built up now during the starting. The disadvantage of the fixed exhaust port 8*a*, however, is that when operating at part load the built-in volume ratio is low and does not correspond with the actual pressure ratio. Consequently, the power used is increased.

A fixed exhaust port is, therefore, not under all circumstances required or desirable.

At a minimum part load, the return port 14 must be as large as possible. It is evident that the size of said port is determined by the axial width of the side flap 11 and by the possible angle of rotation of the regulating ring 10. However, the angle of rotation becomes smaller as the side flap 11 enlarges in axial direction. Therefore, a maximum must be set somewhere for the width of the side flap 11 of the regulating ring 10.

By moving the regulating ring 10 from the position shown in FIG. 2 and 3 into the position illustrated in FIG. 4 and 5, the return port 14 is created, as a result of which gas may escape towards the suction chamber 6. The theoretic amount of gas drawn-in is then as large as the capacity of the groove at the moment when said groove has just passed port 14.

During rotation of the regulating ring 10 from full load to minimum part load, the adjustable exhaust port 8*b* becomes increasingly smaller. The process of expelling the gas starts, therefore, at a continually later moment.

By providing the compressor with side flaps 11 of a different form and/or dimensions, to which, of course, also the groove in the casing 5 has to be adjusted, said compressor obtains a different built-in volume ratio.

For technical manufacturing reasons it is desired that the straight regulating edge 12 of each side flap 11 does not cooperate with a straight regulating edge 13 of the casing 5 but that said regulating edge 13 is disposed on a separate filling ring 17. By providing the compressor with side flaps 11 or with filling rings 17, both of them of different dimensions, the compressor obtains a different built-in volume ratio.

Of course, the built-in volume ratio may be changed only within certain limits by another form and/or dimensions of the side flaps 11 and, if required, of the filling rings 17.

The capacity control in accordance with the invention has the following advantages:

The control is continuous and takes place with the aid of only one movable element.

The range of regulation is considerable, namely from full load to a minimum part load of approximately 25%.

No additional viscous friction is introduced.

There is hardly any loss of capacity.

I claim:

1. In a rotary displacement gas compressor, including a single driven cylindrical rotor provided with spirally-extending grooves, at least two gears having teeth in sealing engagement with said grooves, the axis of rotation of each being perpendicular to a plane passing through the axis of rotation of said rotor, a close-fitting cylindrical casing enclosing said rotor and part of each gear, each gear traversing the wall of said casing, the gas to be compressed being drawn in through the open ends of the grooves at one head end of the rotor, for each gear an exhaust port in the wall of the casing near the other head end of the rotor, seen in the direction of rotation of the rotor in front of the gear, and a pressure pipe connected to each exhaust port, the improvement comprising: for each gear a return port in the wall of the casing at the same axial height as said exhaust ports; a return pipe connecting each return port with the intake side of the compressor; and a single rotatable regulating ring rotating with respect to said casing to control the size of said return ports from a completely closed position to a maximum open position while simultaneously adjusting the size of the exhaust ports in the reverse sense, said regulating ring comprising a fully circular element rotating relative to said casing and having side flaps in the same number as gears, one regulating edge of each side flap adjusting an exhaust port and the other regulating edge adjusting a return port.

2. Rotary displacement compressor in accordance with claim, 1 wherein the regulating ring is accommodated in a circular groove in the casing.

3. Rotary displacement compressor in accordance with claim 1, wherein the regulating edge of every side flap regulating the adjustable exhaust port is inclined in the direction of the groove in the rotor.

4. Rotary displacement compressor in accordance with claim, 1 also including a filling ring having a regulating edge mounted on said casing with said regulating edge being parallel to said rotor axis, and wherein the regulating edge of the side flap regulating the return opening extends parallel to the rotor shaft and co-operates with the regulating edge of said filling ring.

5. Rotary displacement compressor in accordance with claim, 1 further comprising, in addition to said exhaust port that is adjustable, a fixed exhaust port said fixed exhaust port forming an integral part with said adjustable exhaust port.

* * * * *